US007043428B2

(12) United States Patent
Li

(10) Patent No.: US 7,043,428 B2
(45) Date of Patent: May 9, 2006

(54) BACKGROUND NOISE ESTIMATION METHOD FOR AN IMPROVED G.729 ANNEX B COMPLIANT VOICE ACTIVITY DETECTION CIRCUIT

(75) Inventor: Dunling Li, Rockville, MD (US)

(73) Assignee: Texas Instruments Incorporated, Dallas, TX (US)

( * ) Notice: Subject to any disclaimer, the term of this patent is extended or adjusted under 35 U.S.C. 154(b) by 913 days.

(21) Appl. No.: 09/920,710

(22) Filed: Aug. 3, 2001

(65) Prior Publication Data

US 2002/0188445 A1 Dec. 12, 2002

Related U.S. Application Data

(63) Continuation-in-part of application No. 09/871,779, filed on Jun. 1, 2001.

(51) Int. Cl.
*G10L 11/06* (2006.01)

(52) U.S. Cl. ..... 704/233; 704/208; 704/214

(58) Field of Classification Search ..... 704/208, 704/210, 214–216, 226, 228, 233
See application file for complete search history.

(56) References Cited

U.S. PATENT DOCUMENTS 5,839,101 A * 11/1998 Vahatalo et al. ..... 704/226
5,960,389 A * 9/1999 Jarvinen et al. ..... 704/220
5,963,901 A * 10/1999 Vahatalo et al. ..... 704/233
6,002,762 A * 12/1999 Ramsden ..... 379/406.06
6,006,176 A * 12/1999 Hayata ..... 704/214
6,023,674 A 2/2000 Mekuria ..... 704/233
6,028,890 A * 2/2000 Salami et al. ..... 375/216
6,044,342 A * 3/2000 Sato et al. ..... 704/233
6,088,670 A * 7/2000 Takada ..... 704/233
6,125,179 A 9/2000 Wu ..... 379/388
6,141,426 A * 10/2000 Stobba et al. ..... 381/110
6,163,608 A * 12/2000 Romesburg et al. ... 379/406.01
6,185,300 B1 2/2001 Romesburg ..... 379/410
6,223,154 B1 * 4/2001 Nicholls et al. ..... 704/233
6,249,757 B1 * 6/2001 Cason ..... 704/214
6,484,139 B1 * 11/2002 Yajima ..... 704/230
6,519,260 B1 * 2/2003 Galyas et al. ..... 370/395.42
6,549,587 B1 * 4/2003 Li ..... 375/326
6,687,668 B1 * 2/2004 Kim et al. ..... 704/223
6,766,020 B1 * 7/2004 Tian et al. ..... 379/406.05

(Continued)

OTHER PUBLICATIONS

Benyassine et al, "ITU-T Recommendation G.729 Annex B: A Silence Compression for Use with G.729 Optimized for V.70 Digital Simultaneous Voice and Data Applications", IEEE Communications Magazine, Sep. 1997, pp. 64-73.*

(Continued)

*Primary Examiner*—W. R. Young
*Assistant Examiner*—Michael N. Opsasnick
(74) *Attorney, Agent, or Firm*—Abdul Zindani; Wade James Brady, III; Frederick J. Telecky, Jr.

(57) ABSTRACT

A method of initializing an ITU Recommendation G.729 Annex B compliant voice activity detection (VAD) device is disclosed, having the steps of (1) determining a first set of running average background noise characteristics in accordance with Recommendation G.729B; (2) determining a second set of running average background noise characteristics; and (3) substituting the second set of running average background noise characteristics for the first set when a specific event occurs. The specific event is a divergence between the first and second sets of running average background noise characteristics.

7 Claims, 7 Drawing Sheets

U.S. PATENT DOCUMENTS 6,799,160 B1 * 9/2004 Yasunaga et al. ..... 704/223
2001/0007973 A1 * 7/2001 Yajima ..... 704/208

OTHER PUBLICATIONS

Baumgarte, Application of a Physiological Ear Model to Irrelevance Reduction in Audio Coding, Institut fur Theoretische Nachrichtentechnik, pp. 1-11.
Baumgarte, A Physiological Ear Model for Auditory Masking Applicable to Perceptual Coding, Institut fur Theoretische Nachrichtentechnik, pp. 1-36.
Hansen, Assessment and Prediction of Speech Trnasmission Quality with an Auditory Processing Model, Vom Fachbereich Physik der Universitat Oldenburg, Abstract pp. 1-5; Chapter 1 pp. 1-4; Chapter 2 pp. 5-39; Chapter 3 pp. 40-65; Chapter 4 pp. 66-90; Chapter 5 pp. 91-94; Appendix A pp. 95-101; Appendix B pp. 102-104; Appendix C pp. 105-111; Appendix D pp. 112-113; and Bibliography.
Srinivasan et al., High-Quality Audio Compression Using an Adaptive Wavelet Packet Decomposition and Psychoacoustic Modeling, Transactions on Signal Processing, vol. 46, No. 4, Apr. 1998, pp. 1085-1093.
Baumgarte, Evaluation of a Physiological Ear Model Considering Masking Effects Relevant to Audio Coding, Institut fur Theoretische Nachrichtentechnik und Informationsverarbeitung, pp. 1-27.
Azirani et al., Optimizing Speech Enhancement by Exploiting Masking Properties of the Human Ear, Laboratoire de Traitement du Signal et de l'lmage, pp. 800-803.
Baumgarte, A Physiological Ear Model for Auditory Masking Applicable to Perceptual Coding, Institut fur Theoreische Nachrichtentechnik und Informationsverarbeitung, Abstract, pp. 1-15; Chapter 2, pp. 5-39; Chapter 3, pp. 40-64.
Baumgarte, Evaluation of a Physiological Ear Model for the Simulation of Nonlinear Masking Effects, Universitat Hannover, Hannover, Germany, pp. 1-4.
Johan Haeggstrom, Nokia Telecommunications, IP Telephony, Oct. 26, 1998, pp. 1-46.
Rosenberg, G.729 Error Recovery for Internet Telephony, Lucent Technologies, Bell Laboratories & Columbia University, pp. 1-25.
Koehler, Physics of Hearing, 1996, pp. 1-3.
Prolog to Speech Coding: A Tutorial Review, by Spanias, pp. 1-8.

* cited by examiner

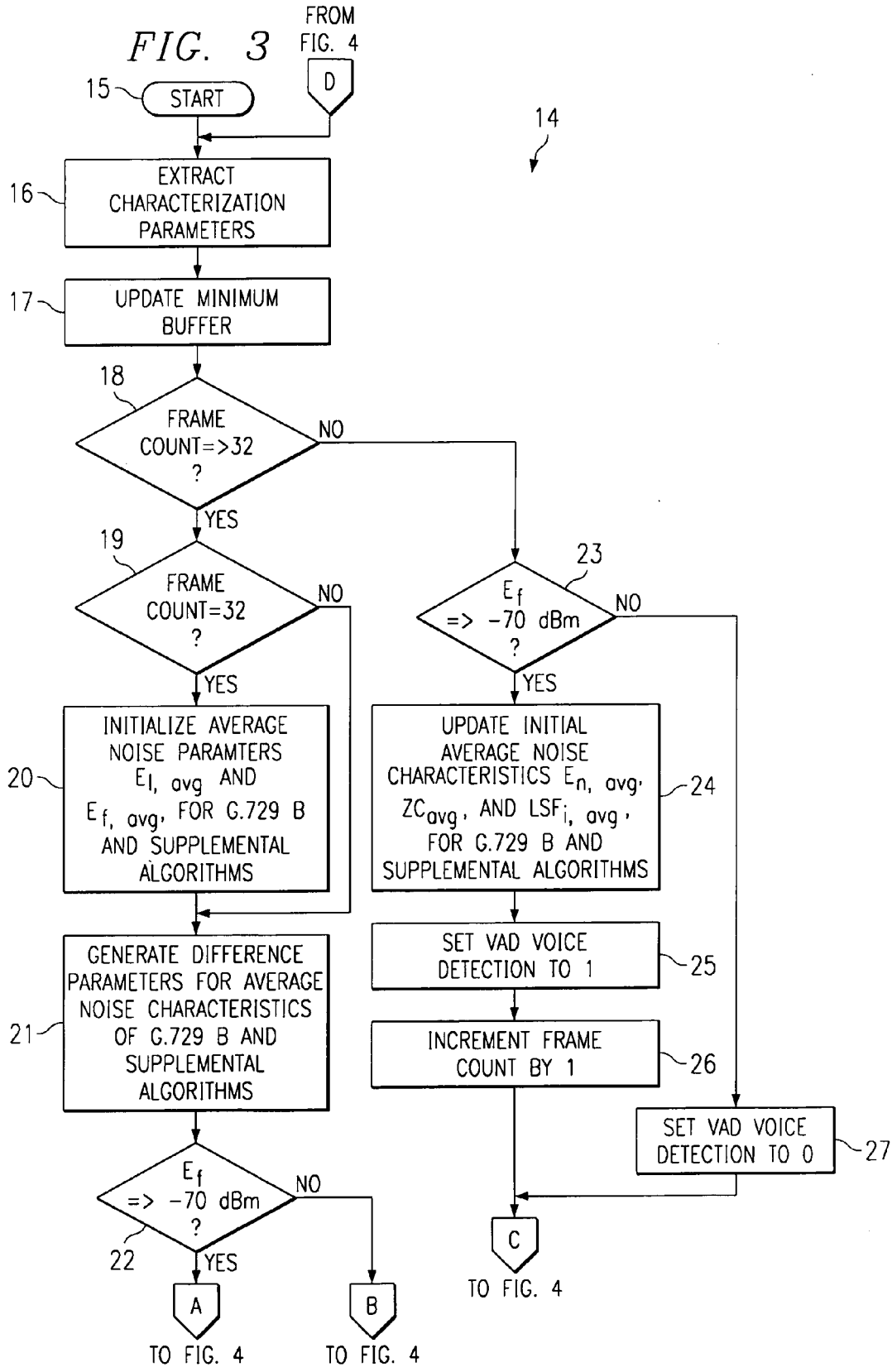
FIG. 3
FROM FIG. 4
D
15
START
14
16
EXTRACT CHARACTERIZATION PARAMETERS
17
UPDATE MINIMUM BUFFER
18
FRAME COUNT=>32 ?
NO
YES
19
FRAME COUNT=32 ?
NO
YES
23
$E_f$ => -70 dBm ?
NO
YES
20
INITIALIZE AVERAGE NOISE PARAMTERS $E_{l,\ avg}$ AND $E_{f,\ avg}$, FOR G.729 B AND SUPPLEMENTAL ALGORITHMS
UPDATE INITIAL AVERAGE NOISE CHARACTERISTICS $E_{n,\ avg}$, $ZC_{avg}$, AND $LSF_{i,\ avg}$, FOR G.729 B AND SUPPLEMENTAL ALGORITHMS
24
21
GENERATE DIFFERENCE PARAMETERS FOR AVERAGE NOISE CHARACTERISTICS OF G.729 B AND SUPPLEMENTAL ALGORITHMS
SET VAD VOICE DETECTION TO 1
25
INCREMENT FRAME COUNT BY 1
26
SET VAD VOICE DETECTION TO 0
27
$E_f$ => -70 dBm ?
NO
22
YES
A
TO FIG. 4
B
TO FIG. 4
C
TO FIG. 4

BACKGROUND NOISE ESTIMATION METHOD FOR AN IMPROVED G.729 ANNEX B COMPLIANT VOICE ACTIVITY DETECTION CIRCUIT

CROSS-REFERENCE TO RELATED APPLICATIONS

This application s a continuation in part of patent application Ser. No. 09/871,779 filed Jun. 1, 2001 and entitled "Method for Converging a G.729 Annex B Compliant Voice Activity Detection," which is incorporated herein by reference.

FIELD OF THE INVENTION

The invention relates to improving the estimation of background noise characteristics in a communication channel by a G.729 voice activity detection (VAD) device. Specifically, the invention establishes a better initial estimate of the average background noise characteristics and converges all subsequent estimates of the average background noise characteristics toward their actual values. By so doing, the invention improves the ability of the G.729 VAD to distinguish voice from background noise and thereby reduces the bandwidth needed to support the communication channel, without any speech quality degradation. The invention is standard compliant in that it passes all of the G.729 test vectors.

BACKGROUND OF THE INVENTION

The International Telecommunication Union (ITU) Recommendation G.729 Annex B describes a compression scheme for communicating information about the background noise received in an incoming signal when no voice is detected in the signal. This compression scheme is optimized for terminals conforming to Recommendation V.70. The teachings of ITU-T G.729 and Annex B of the Recommendation are hereby incorporated into this application by reference.

Traditional speech encoders/decoders (codecs) use synthesized comfort noise to simulate the background noise of a communication link during periods when voice is not detected in the incoming signal. By synthesizing the background noise, little or no information about the actual background noise need be conveyed through the communication channel of the link. However, if the background noise is not statistically stationary (i.e., the distribution function varies with time), the simulated comfort noise does not provide the naturalness of the original background noise. Therefore it is desirable to occasionally send some information about the background noise to improve the quality of the synthesized noise when no speech is detected in the incoming signal. An adequate representation of the background noise, in a digitized frame (i.e., a 10 ms portion) of the incoming signal, can be achieved with as few as fifteen digital bits, substantially fewer than the number needed to adequately represent a voice signal. Recommendation G.729 Annex B suggests communicating a representation of the background noise frame only when an appreciable change has been detected with respect to the previously transmitted characterization of the background noise frame, rather than automatically transmitting this information whenever voice is not detected in the incoming signal. Because little or no information is communicated over the channel when there is no voice in the incoming signal, a substantial amount of channel bandwidth is conserved by the compression scheme.

FIG. 1 illustrates a half-duplex communication link conforming to Recommendation G.729 Annex B. At the transmitting side of the link, a VAD module 1 generates a digital output to indicate the detection of noise or voice in the incoming signal. An output value of one indicates the detected presence of voice and a value of zero indicates its absence. If the VAD 1 detects voice, a G.729 speech encoder 3 is invoked to encode the digital representation of the detected voice signal. However, if the VAD 1 does not detect voice, a Discontinuous Transmission/Comfort Noise Generator (noise) encoder 2 is used to code the digital representation of the detected background noise signal. The digital representations of these voice and background noise signals 7 are formatted into data frames containing the information from samples of the incoming signal taken during consecutive 10 ms periods.

At the decoder side, the received bit stream for each frame is examined. If the VAD field for the frame contains a value of one, a voice decoder 6 is invoked to reconstruct the signal for the frame using the information contained in the digital representation. If the VAD field for the frame contains a value of zero, a noise decoder 5 is invoked to synthesize the background noise using the information provided by the associated encoder.

To make a determination of whether a frame contains voice or noise, the VAD 1 extracts and analyzes four parametric characteristics of the information within the frame. These characteristics are the full- and low-band energies, the set of Line Spectral Frequencies (LSF), and the zero cross rate. A difference measure between the extracted characteristics of the current frame and the running averages of the background noise characteristics is calculated for each frame. Where small differences are detected, the characteristics of the current frame are highly correlated to those of the running averages for the background noise and the current frame is more likely to contain background noise than voice. Where large differences are detected, the current frame is more likely to contain a signal of a different type, such as a voice signal.

An initial VAD decision regarding the content of the incoming frame is made using multi-boundary decision regions in the space of the four differential measures, as described in ITU G.729 Annex B. Thereafter, a final VAD decision is made based on the relationship between the detected energy of the current frame and that of neighboring past frames. This final decision step tends to reduce the number of state transitions.

The running averages of the background noise characteristics are updated only in the presence of background noise and not in the presence of speech. The characteristics of the incoming frame are compared to an adaptive threshold and an update takes place only if certain conditions are met, as described in Recommendation G.729 B.

When the specified conditions are met, the running averages of the background noise characteristics are updated to reflect the contribution of the current frame using a first order Auto-Regressive (AR) scheme. Different AR coefficients are used for different parameters, and different sets of coefficients are used at the beginning of the communication or when a large change of the noise characteristics is detected. These AR coefficients are related to the running averages of the four background noise characteristics, $\{\overline{LSF}_i\}_{i=1}^{10}$, $\overline{E}_f$, $\overline{E}_l$, and $\overline{ZC}$, in the following way.

Let $\beta_{E_f}$ identify the AR coefficient for the update of $\overline{E}_f$, $\beta_{E_l}$ identify the AR coefficient for the update of $\overline{E}_l$, $\beta_{ZC}$ identify the AR coefficient for the update of $\overline{ZC}$, and $\beta_{LSF}$ identify the AR coefficient for the update of $\{\overline{LSF}_i\}_{i=1}^{P}$. The AR update is done according to the equations:

$$\overline{E}_f=\beta_{E_f}\cdot\overline{E}_f+(1-\beta_{E_f})\cdot E_f; \quad (1)$$

$$\overline{E}_l=\beta_{E_l}\cdot\overline{E}_l+(1-\beta_{E_l})\cdot E_l; \quad (2)$$

$$\overline{ZC}=\beta_{ZC}\cdot\overline{ZC}+(1-\beta_{ZC})\cdot ZC; \text{ and} \quad (3)$$

$$\overline{LSF}_i=\beta_{LSF}\cdot\overline{LSF}_i+(1-\beta_{LSF})\cdot LSF_i. \quad (4)$$

The running averages of the background noise characteristics are initialized by averaging the characteristics for the first thirty-two frames (i.e., the first 320 ms) of an established link. If all of the first thirty-two frames have full-band energies $E_f$ of less than 15 dB, then the four background noise characteristics, $\{\overline{LSF}_i\}_{i=1}^{10}$, $\overline{E}_f$, $\overline{E}_l$, and $\overline{ZC}$, are initialized to zero.

Based on the conditions established by G.729 Annex B, described above, for updating the running averages of the background noise characteristics, there are common circumstances that cause the running averages to substantially diverge from the background noise characteristics of the current and future frames. These circumstances occur because the conditions for determining when to update the running averages are dependent upon the values of the running averages. Substantial variations of the background noise characteristics, occurring in a brief period of time, decrease the correlation between the current background noise characteristics and the expected background noise characteristics, as represented by the running averages of these characteristics. As the correlation diverges, the VAD 1 has increasing difficulty distinguishing frames of background noise from those containing voice. When the divergence reaches a critical point, the VAD 1 can no longer accurately distinguish the background noise from voice and, therefore, will no longer update the running averages of the background noise characteristics. Additionally, the VAD 1 will interpret all subsequent incoming signals as voice signals, thereby eliminating the bandwidth savings obtained by discriminating the voice and noise.

Without some modification to the algorithm described in Recommendation G.729 Annex B, once the running averages of the background noise characteristics and the actual characteristics become critically diverged, the VAD 1 will not perform as intended through the remaining duration of the established link. Critical divergence occurs in real-world applications when:

1. The VAD receives a very low-level signal at the onset of the channel link and for more than 320 ms;
2. The VAD receives a signal that is not representative of the background noise at the onset of the channel link and for more than 320 ms; and
3. The characteristic features of the background noise change rapidly.

In the first instance, the beginning of the vector containing the running average of the background noise characteristics is initialized with all zeros. In the second instance, the vector contains values far different from the real background noise characteristics. And in the third instance, the spectral distortion, ΔS, will never be less than 83, as is required to cause an update. As the VAD 1 increasingly allocates resources to the conveyance of noise through the communication channel 4, it proportionately decreases the efficiency of the channel 4. An inefficient communication channel is an expensive one. The present invention overcomes these deficiencies.

For completeness, a description of the four parameters used to characterize the background noise are described below. Let the set of autocorrelation coefficients extracted from a frame of information representing a 10 ms portion of an incoming signal be designated by:

$$\{R(i)\}_{i=0}^{12}$$

A set of line spectral frequencies is derived from the autocorrelation coefficients, in accordance with Recommendation G.729, and is designated by:

$$\{LSF_i\}_{i=1}^{10}$$

As stated previously, the full-band energy $E_f$ is obtained through the equation:

$$E_f = 10\times\log_{10}\left[\frac{1}{240}\times R(0)\right],$$

where R(0) is the first autocorrelation coefficient;

The low-band energy, measured between the frequency spectrum of zero to some upper frequency limit, $F_1$, is obtained through the equation:

$$E_l = 10\times\log_{10}\left[\frac{1}{240}\times h^T\times R\times h\right],$$

where h is the impulse response of an FIR filter with a cutoff frequency at $F_1$ Hz and R is the Toeplitz autocorrelation matrix with the autocorrelation coefficients on each diagonal.

The normalized zero crossing rate is given by the equation:

$$ZC = \frac{1}{160}\times\sum[|sgn(x(i))-sgn(x(i-1))|],$$

where x(i) is the pre-processed input signal.

For the first thirty-two frames, the average spectral parameters of the background noise, denoted by $\{\overline{LSF}_i\}_{i=1}^{10}$, are initialized as an average of the line spectral frequencies of the frames and the average of the background noise zero crossing rate, denoted by $\overline{ZC}$, is initialized as an average of the zero crossing rate, ZC, of the frames. The running averages of the full-band background noise energy, denoted by $\overline{E}_f$, and the background noise low-band energy, denoted by $\overline{E}_l$, are initialized as follows. First, the initialization procedure calculates $\overline{E}_n$, which is the average frame energy, $E_f$, over the first thirty-two frames. Note, the three parameters, $\{\overline{LSF}_i\}_{i=1}^{10}$, $\overline{ZC}$, and $\overline{E}_n$, are only averaged over the frames that have an energy, $E_f$, greater than 15 dB. Thereafter, the initialization procedure sets the parameters as follows:

If $\overline{E}_n \leqq 671{,}088{,}640$, then $$\overline{E}_f=\overline{E}_n$$

$$\overline{E}_l=\overline{E}_n-53{,}687{,}091$$

else if $671{,}088{,}640<\overline{E}_n<738{,}197{,}504$ then $$\overline{E}_f=\overline{E}_n-67{,}108{,}864$$

$\overline{E}_l=\overline{E}_n-93{,}952{,}410$ else $\overline{E}_f=\overline{E}_n-134{,}217{,}728$ $\overline{E}_l=\overline{E}_n-161{,}061{,}274$ A long-term minimum energy parameter, $E_{min}$, is calculated as the minimum value of $E_f$ over the previous 128 frames.

Four differential values are generated from the differences between the current frame parameters and the running averages of the background noise parameters. The spectral distortion differential value is generated as the sum of squares of the difference between the current frame $\{LSF^i\}_{i=1}^{10}$ vector and the running averages of the spectral distortion $\{\overline{LSF}_i\}_{i=1}^{10}$ and may be expressed by the equation:

$$\Delta S = \sum_{i=1}^{10} (LSF_i - \overline{LSF}_i)^2$$

The full-band energy differential value may be expressed as:

$\Delta E_f=\overline{E}_f-E_f$, where $E_f$ is the full-band energy of the current frame.

The low-band energy differential value may be expressed as:

$\Delta E_l=\overline{E}_l-E_l$, where $E_l$ is the low-band energy of the current frame.

Lastly, the zero crossing rate differential value may be expressed as:

$\Delta ZC=\overline{ZC}-ZC$, where ZC is the zero crossing rate of the current frame.

SUMMARY OF THE INVENTION

Since the problem occurs with communications conforming to ITU G.729 Annex B, the solution to the problem must improve upon the Recommendation without departing from its requirements. The key to achieving this is to make the condition for updating the background noise parameters independent of the value of the updated parameters. The solution includes the supplemental steps of: (1) determining a first set of running average background noise characteristics in accordance with Recommendation G.729B; (2) determining a second set of running average background noise characteristics; and (3) substituting the second set of running average background noise characteristics for the first set when a specific event occurs. The specific event is a divergence between the first and second sets of running average background noise characteristics. Additionally, the disclosed invention includes eliminating all of the frames having a very low energy level, such as below 15 dB, from: (1) updating the background noise characteristics and (2) contributing toward the frame count used to determine the end of the initialization period.

The supplemental algorithm establishes two thresholds that are used to maintain a margin between the domains of the most likely noise and voice energies. One threshold identifies an upper boundary for noise energy and the other identifies a lower boundary for voice energy. If the current frame energy is less than or equal to the noise energy threshold, then the parameters extracted from the signal of the current frame are used to characterize the expected background noise energy for the supplemental algorithm and update the set of noise parameters for the supplemental algorithm. If the current frame energy is greater than the voice threshold, then the parameters extracted from the signal of the current frame are used to update the average voice energy for the supplemental algorithm. A frame energy lying between the noise and voice thresholds will not be used to update the characterization of the background noise or the noise and voice energies for the supplemental algorithm.

Because the noise and voice threshold levels are determined in a way that supports more frequent updates to the running averages of the background noise characteristics than is obtained through the G.729 Annex B algorithm, the running averages of the supplemental algorithm are more likely to reflect the expected value of the background noise characteristics for the next frame. By substituting the supplemental algorithm's characterization of the background noise for that of the G.729 Annex B algorithm, the estimations of noise parameters may be decoupled and made independent of the G.729 Annex B characterization when divergence occurs. Both the noise threshold and voice threshold are based on minimum and maximum block energy and the average noise and voice energies during one updating period and these threshold values are updated every N=50 frames (i.e., every 500 ms).

BRIEF DESCRIPTION OF THE DRAWINGS

Preferred embodiments of the invention are discussed hereinafter in reference to the drawings, in which:

FIG. 3—illustrates the process flow for the integrated G.729 Annex B and supplemental VAD algorithms;

DETAILED DESCRIPTION OF THE INVENTION

Figure 1:
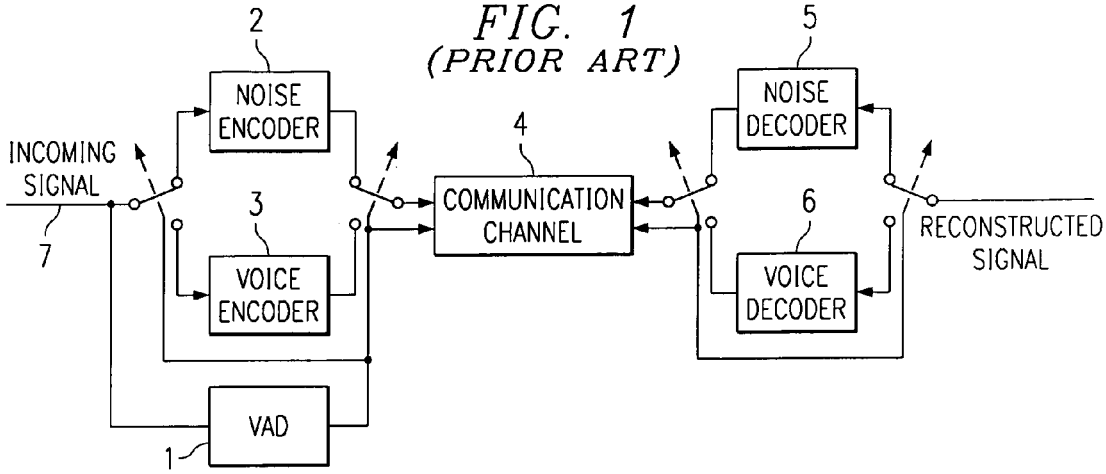
FIG. 1 (PRIOR ART)
FIG. 1—illustrates a half-duplex communication link conforming to Recommendation G.729 Annex B.
Figure 2:
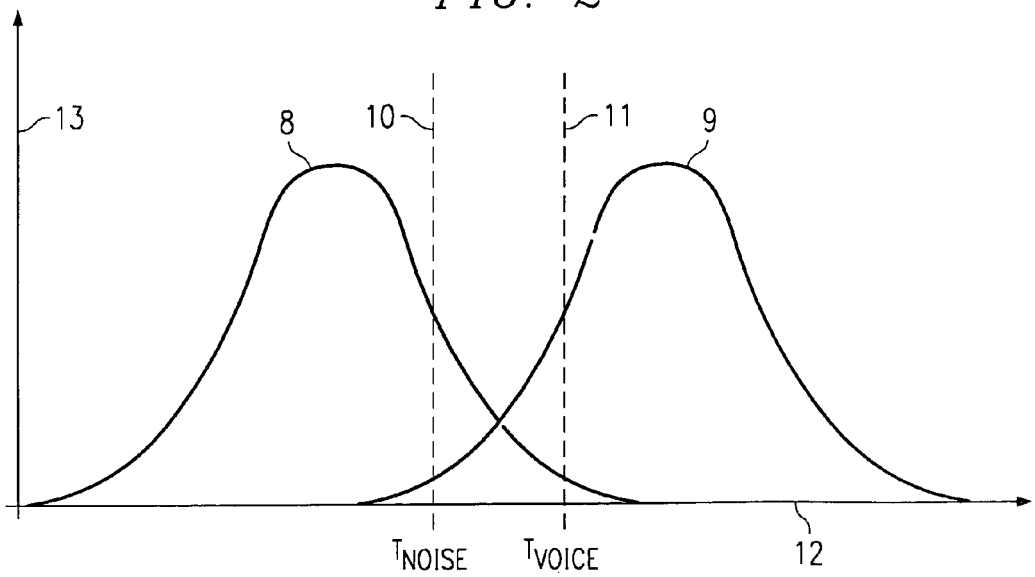
FIG. 2—illustrates representative probability distribution functions for the background noise energy and the voice energy at the input of a G.729 Annex B communication channel.

FIG. 2 illustrates representative probability distribution functions for the background noise energy 8 and the voice energy 9 at the input of a G.729 Annex B communication channel. In this figure, the horizontal axis 12 shows the domain of energy levels and the vertical axis 13 shows the probability density range for the plotted functions 8, 9. A dynamic noise threshold 10 is mathematically determined and used to mark the upper boundary of the energy domain that is likely to contain background noise alone. Similarly, a dynamic voice threshold 11 is mathematically determined and used to mark the lower boundary of the energy domain that is likely to contain voice energy. The dynamic thresholds 10, 11 vary in accordance with the noise and voice energy probability distribution functions 8, 9, for the time period, $\tau$, in which the probability distribution functions are established.

A supplemental algorithm is used to determine the noise and voice thresholds 10, 11 for each period, $\tau$, of the established probability distribution functions. This period is preferably 500 ms in length and, therefore, the noise and voice thresholds are updated every 500 ms. The supplemental algorithm updates the noise and voice thresholds 10, 11 in the following way. Let, $E_{max}$=the maximum block energy measured during the current updating period, $\tau_p$;

$E_{min}$=the minimum block energy measured during the current updating period, $\tau_p$;

$$T_1=E_{min}+(E_{max}-E_{min})/32;$$

$$T_2=4*E_{min};$$

$$T_3=\overline{E}_{noise}+4\cdot\left(\frac{\overline{E}_{voice}-\overline{E}_{noise}}{\overline{E}_{voice}+\overline{E}_{noise}}\right)\cdot\overline{E}_{noise};$$

and $$T_4=\overline{E}_{voice}-\frac{1}{2}\cdot\left(\frac{\overline{E}_{voice}-\overline{E}_{noise}}{\overline{E}_{voice}+\overline{E}_{noise}}\right)\cdot\overline{E}_{voice}$$

$$\text{If } \frac{\overline{E}_{voice}}{\overline{E}_{noise}}>20\text{ dB},$$

then $$T_{noise}=\min\{\max\{T_3, -50\text{ dBm0}\}, -30\text{ dBm0}\};\text{ and}$$

$$T_{voice}=\min\{\max\{T_4, -40\text{ dBm0}\}, -20\text{ dBm0}\};$$

else, $$T_5=2\cdot\min\{T_1, T_2\};$$

$$T_6=\alpha\cdot\max\{T_1, T_2\};$$

$$T_{noise}=\min\{\max\{\min\{T_3, T_5\}, -50\text{ dBm0}\}, -30\text{ dBm0}\};\text{ and}$$

$$T_{voice}=\min\{\max\{T_4, T_6, -40\text{ dBm0}\}, -20\text{ dBm0}\};$$

where, $\alpha=16$, when $E_{max}/E_{min}>35$ dB; and $\alpha=4$, when $E_{max}/E_{min}\leqq 35$ dB.

The above-listed equations may be explained textually in the following way. When $$\frac{\overline{E}_{voice}}{\overline{E}_{noise}}>20\text{ dB},$$

$T_{noise}$ is calculated for the current updating period, $\tau_p$, by first determining the greater of the two values $T_3$ and −50 dBm0. The greater value of $T_3$ and −50 dBm0 is then compared to a value of −30 dBm0. The lesser value of the latter comparison is assigned to the parameter identifying the noise threshold, $T_{noise}$, for the current updating period, $\tau_p$. $T_{voice}$ is calculated for the current updating period, $\tau_p$, by first determining the greater of the two values $T_4$ and −40 dBm0. The greater value of $T_4$ and −40 dBm0 is then compared to a value of −20 dBm0. The lesser value of the latter comparison is assigned to the parameter identifying the voice threshold, $T_{voice}$, for the current updating period, $\tau_p$.

When $$\frac{\overline{E}_{voice}}{\overline{E}_{noise}}\leq 20\text{ dB},$$

$T_{noise}$ is calculated for the current updating period, $\tau_p$, by first determining the lesser of the two values $T_3$ and $T_5$. The lesser value is then compared to a value of −50 dBm0. The greater value of −50 dBm0 and the lesser value of the first comparison is compared to −30 dBm0. Finally, the lesser value of the last comparison is assigned to the parameter identifying the noise threshold, $T_{noise}$, for the current updating period, $\tau_p$. $T_{voice}$ is calculated for the current updating period, $\tau_p$, by first determining the greater of the three values $T_4$, $T_6$, and −40 dBm0. The greater value is compared to a value of −20 dBm0. Next, the lesser value of the latter comparison is assigned to the parameter identifying the voice threshold, $T_{voice}$, for the current updating period, $\tau_p$.

As an aside, the noise and voice probability distribution functions for each updating period, $\tau$, may be determined from the sets $\{E_{voice}(1), E_{voice}(2), E_{voice}(3), \ldots, E_{voice}(j)\}$ and $\{E_{noise}(1), E_{noise}(2), E_{noise}(3), \ldots, E_{noise}(j)\}$, where j is the highest-valued block index within the updating period. These set values are calculated using the following equations:

$$\overline{E}_{voice}(n)=(1-\alpha_{voice})\cdot\overline{E}_{voice}(n-1)+\alpha_{voice}\cdot E(n);\text{ and} \quad (5)$$

$$\overline{E}_{noise}(n)=(1-\alpha_{noise})\cdot\overline{E}_{noise}(n-1)+\alpha_{noise}\cdot E(n); \quad (6)$$

where,

E(n)=the $n^{th}$ 10 ms block energy measurement within the current updating period, $\tau_p$;

$\alpha_{voice}=1/8$, when $E(n)>T_{voice}$;

$\alpha_{voice}=0$, when $E(n)\leqq T_{voice}$;

$\alpha_{noise}=1/4$, when $E(n)<T_{noise}$; and $\alpha_{noise}=0$, when $E(n)\geqq T_{noise}$.

In addition to updating the noise and voice energy thresholds for each updating period, $\tau$, the supplemental algorithm compares the two thresholds to the full-band energy, $E_f$, of each incoming energy frame of the signal to decide when to update the running averages of the supplemental background noise characteristics. Whenever the full-band energy of the current frame falls below the noise threshold, the running averages of the supplemental background noise characteristics are updated. Whenever the full-band energy of the current frame exceeds the voice threshold, the running average of the voice energy, $\overline{E}_{voice}$, is updated. A frame having a block energy equal to a threshold or between the two thresholds is not used to update either the running averages of the supplemental background noise characteristics or the supplemental voice energy characteristics. The running averages of the supplemental background noise and voice characteristics are updated using equations (1), (2), (3), (4), (5), and (6), listed above.

The supplemental VAD algorithm operates in conjunction with a G.729 Annex B VAD algorithm, which is the primary algorithm. As described in the Background of the Invention section, the primary VAD algorithm compares the characteristics of the incoming frame to an adaptive threshold. An update to the primary background noise characteristics takes place only if the following three conditions are met:

$$E_f<+614; \quad 1)$$

$$RC(1)\overline{E}_f<24576; \text{ and} \quad 2)$$

$$\Delta S<83. \quad 3)$$

In a realistic scenario, the running averages of the background noise characteristics for the supplemental algorithm will be updated more frequently than those of the primary algorithm. Therefore, the running averages for the background noise characteristics of the supplemental algorithm are more likely to reflect the actual characteristics for the next incoming frame of background noise.

A count, $N_{update}$, of the number of consecutive incoming frames that fail to cause an update to the running averages of the primary background noise characteristics is kept by the supplemental algorithm. Similarly, a count, $N_{voice}$, of the number of consecutive incoming frames that the G.729 B VAD declares as voice is kept by the supplemental algorithm. When $N_{update}$ reaches a critical value, $T_{Nup}$, it may be reasonably assumed that the running averages of the primary background noise characteristics have substantially diverged from the actual current values and that a re-convergence using the G.729 Annex B algorithm, alone, will not be possible. However, convergence may be established by substituting the running averages of the supplemental background noise characteristics for those of the primary background noise characteristics. The conditions for deciding whether to substitute the supplemental background noise characteristics for those of the primary characteristics are the following:

$$N_{update}>T_{Nup}; \text{ and}$$

$$N_{voice}>5000 \text{ (i.e., 5 seconds).}$$

Therefore, the supplemental algorithm provides information complementary to that of the primary algorithm. This information is used to maintain convergence between the expected values of the background noise characteristics and their actual current values. Additionally, the supplemental algorithm prevents extremely low amplitude signals from biasing the running averages of the background noise characteristics during the initialization period. By eliminating the a typical bias, the supplemental algorithm better converges the initial running averages of the primary background noise characteristics toward realistic values.

Figure 4:
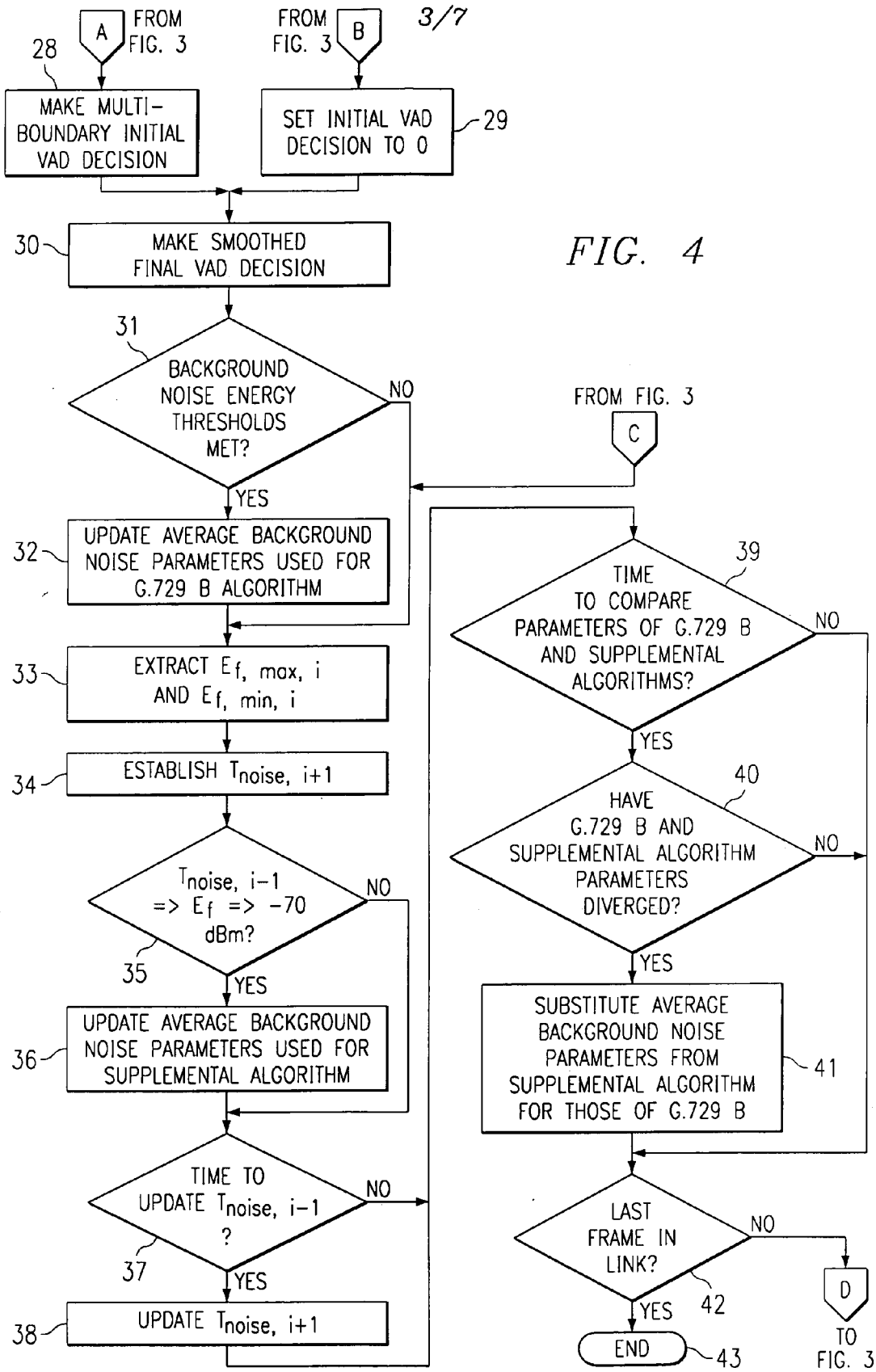
FIG. 4—illustrates a continuation of the process flow of FIG. 3.

The complementary aspects of the G.729 Annex B and the supplementary VAD algorithms are discussed in greater detail in the following paragraphs and with reference to FIGS. 3 and 4. Although the two VAD algorithms are preferably separate entities that execute in parallel, they are illustrated in FIGS. 3 and 4 as an integrated process 14 for ease of illustration and discussion.

When a communication link is established, the integrated process 14 is started 15. Acoustical analog signals received by the microphone of the transmitting side of the link are converted to electrical analog signals by a transducer. These electrical analog signals are sampled by an analog-to-digital (A/D) converter and the sampled signals are represented by a number of digital bits. The digitized representations of the sampled signals are formed into frames of digital bits. Each frame contains a digital representation of a consecutive 10 ms portion of the original acoustical signal. Since the microphone continually receives either the speaker's voice or background noise, the 10 ms frames are continually received in a serial form by the G.729 Annex B VAD and the supplemental VAD.

A set of parameters characterizing the original acoustical signal is extracted from the information contained within each frame, as indicated by reference numeral 16. These parameters are $\{\overline{LSF}_i\}_{i=1}^{10}$, $\overline{E}_f$, $\overline{E}_l$, and $\overline{ZC}$. The update to the minimum buffer 17, as described in G.729, is performed after the extraction of the characterization parameters.

A comparison of the frame count with a value of thirty-two is performed, as indicated by reference numeral 18, to determine whether an initialization of the running averages of the noise characteristics has taken place. If the number of frames received by the G.729 Annex B VAD having a full-band energy equal to or greater than 15 dB, since the last initialization of the frame count, is less than thirty-two, then the integrated process 14 executes the noise characteristic initialization process, indicated by reference numerals 23–25 and 27.

Occasionally, a communication link may have a period of extremely low-level background noise. To prevent this a typical period of background noise from negatively biasing the initial averaging of the noise characteristics, the integrated process 14 filters the incoming frames. A comparison of the current frame's full-band energy to a reference level of 15 dB is made, as indicated by reference numeral 23. If the current frame's energy equals or exceeds the reference level, then an update is made to the initial average frame energy, $\overline{E}_n$, the average zero-crossing rate, $\overline{ZC}$, and the average line spectral frequencies, $\{\overline{LSF}_i\}_{i=1}^{10}$, as indicated by reference numeral 24 and described in Recommendation G.729 Annex B. Thereafter, the G.729 Annex B VAD sets an output to one to indicate the detected presence of voice in the current frame, as indicated by reference numeral 25, and increments the frame count by a value of one 26. If the current frame's energy is less than the reference level, the G.729 Annex B VAD sets its output to zero to indicate the non-detection of voice in the current frame, as indicated by reference numeral 27, and the frame counter will not be incremented in this case. After the G.729 Annex B VAD makes the decision regarding the presence of voice 25, 27, the integrated process 14 continues with the extraction of the maximum and minimum frame energy values 33.

For each received frame having a full-band energy equal to or greater than 15 dB, the frame count is incremented by a value of one. When the frame count equals thirty-two, as determined by the comparison indicated by reference numeral 19, the integrated process 14 initializes the running averages of the low-band noise energy, $\overline{E}_l$, the full-band energy, $\overline{E}_f$, the average line spectral frequencies $\{\overline{LSF}_i\}_{i=1}^{p}$, and the zero crossing rate $\overline{ZC}$, as indicated by reference numeral 20 and described in Recommendation G.729 Annex B.

Next, the differential values between the background noise characteristics of the current frame and the running averages of these noise characteristics are generated, as indicated by reference numeral 21. This process step is performed after the initialization of the running averages of the noise characteristic parameters, when the frame count is thirty-two, but is performed directly after the frame count comparison, indicated by reference numeral 19, when the frame count exceeds thirty-two. Recommendation G.729 Annex B describes the method for generating the difference parameters used by the G.729 Annex B VAD. After the difference parameters are generated, a comparison of the current frame's full-band energy is made with the reference value of 15 dB, as indicated by reference numeral 22.

Referring now to FIG. 3, a multi-boundary initial G.729 Annex B VAD decision is made 28 if the current frame's full-band energy equals or exceeds the reference value. If the reference value exceeds the current frame's full-band energy, then the initial G.729 Annex B VAD decision generates a zero output 29 to indicate the lack of detected voice in the current frame. Regardless of the initial value assigned, the G.729 Annex B VAD refines the initial decision to reflect the long-term stationary nature of the voice signal, as indicated by reference numeral 30 and described in Recommendation G.729 Annex B.

After the initial VAD decision has been smoothed, with respect to preceding VAD decisions, to form a final VAD decision, the integrated process makes a determination of whether the background noise update conditions have been met by the noise characteristics of the current frame, as indicated by reference numeral 31. An update to the running averages of the G.729 Annex B noise characteristics 32 takes place only if the following three conditions are met:

$$E_f<\overline{E}_f+614; \quad 1)$$

$$RC(1)<24576; \text{ and} \quad 2)$$

$$\Delta S<83. \quad 3)$$

where, $E_f$=the full-band noise energy of the current frame;

$\overline{E}_f$=the average full-band noise energy;

RC(1)=the first reflection coefficient; and

ΔS=the difference between the measured spectral distance for the current frame and the running average value of the spectral distance. The full-band noise energy $E_f$ is further updated, as is a counter, $C_n$, of noise frames, according to the following conditions:

$$\overline{E}_f=E_{min}; \text{ and}$$

$$C_n=0,$$

when, $$C_n>128; \text{ and}$$

$$\overline{E}_f<E_{min}.$$

Textually stated, the running averages of the G.729 Annex B background noise characteristics are updated 32 to reflect the contribution of the current frame using a first order auto-regressive scheme, based on equations (1), (2), (3), and (4).

Integrated process 14 measures the full-band energy of each incoming frame. For every period, i, of 500 ms, the maximum and minimum full-band energies are identified 33 and used to generate the noise and voice thresholds for the next period, i+1. This process of identifying maximum and minimum full-band energies, $E_{max}$ and $E_{min}$, during period i to generate the noise threshold, $T_{noise,i+1}$, for the next time period is performed when any of the following conditions are met:

1. a G.729 Annex B VAD output decision is made while the frame count is less than thirty-two;

2. the G.729 Annex B background noise update conditions are not met, as determined in the step identified by reference numeral 31; or 3. an update to the running averages of the G,729 Annex B background noise characteristics is made, as identified by reference numeral 32.

The value of $T_{noise,i}$ for the first time period, i, is initialized to −55 dBm and $T_{voice,i}$ is initialized to −40 dBm0. For all subsequent periods, i, the supplemental algorithm generates the noise and voice thresholds 10, 11 in the following way:

$E_{max}$=the maximum block energy measured during the current updating period, $\tau_p$;

$E_{min}$=the minimum block energy measured during the current updating period, $\tau_p$;

$$T_1=E_{min}+(E_{max}-E_{min})/32;$$

$$T_2=4*E_{min};$$

$$T_3=\overline{E}_{noise}+4\cdot\left(\frac{\overline{E}_{voice}-\overline{E}_{noise}}{\overline{E}_{voice}+\overline{E}_{noise}}\right)\cdot\overline{E}_{noise};$$

and $$T_4=\overline{E}_{voice}-\frac{1}{2}\cdot\left(\frac{\overline{E}_{voice}-\overline{E}_{noise}}{\overline{E}_{voice}+\overline{E}_{noise}}\right)\cdot\overline{E}_{voice}.$$

If $$\frac{\overline{E}_{voice}}{\overline{E}_{noise}}>20 \text{ dB},$$

then $$T_{noise}=\min\{\max\{T_3, -50 \text{ dBm0}\}, -30 \text{ dBm0}\}; \text{ and}$$

$$T_{voice}=\min\{\max\{T_4, -40 \text{ dBm0}\}, -20 \text{ dBm0}\};$$

else, $$T_5=2\cdot\min\{T_1, T_2\};$$

$$T_6=\alpha\cdot\max\{T_1, T_2\};$$

$$T_{noise}=\min\{\max\{\min\{T_3, T_5\}, -50 \text{ dBm0}\}, -30 \text{ dBm0}\}; \text{ and}$$

$$T_{voice}=\min\{\max\{T_4, T_6, -40 \text{ dBm0}\}, -20 \text{ dBm0}\};$$

where, $$\alpha=16, \text{ when } E_{max}/E_{min}>35 \text{ dB; and}$$

$$\alpha=4, \text{ when } E_{max}/E_{min}\leqq 35 \text{ dB}.$$

Next, the full-band energy of the current frame is compared to the 15 dB reference and to the noise threshold, $T_{noise}$, 10 generated by the supplemental VAD algorithm, as indicated by reference numeral 35. If the full-band energy of the current frame equals or exceeds the reference level and equals or falls below the noise threshold 10, $T_{noise}$, then $\bar{E}_{noise}$ and the running averages of the background noise characteristics, generated by the supplemental VAD algorithm, are updated using the auto-regressive algorithm given by equation (5). This update is indicated in the integrated process flowchart 14 by reference numeral 36. If a negative determination is made for the current frame in the comparison identified by reference numeral 35, a decision is made whether to update $\bar{E}_{voice}$, as indicated by reference numeral 66. If the current frame energy $E_f > T_{voice}$, then $\bar{E}_{voice}$ is updated, as indicated by reference numeral 67, according to equation (6).

After step 36, 67, or a negative determination is made in step 66, a decision is made whether to update the noise threshold 10 and voice threshold 11, as indicated by reference numeral 37. If about 500 ms has passed since the last update to the noise and voice thresholds 10, 11, then the noise and voice thresholds are updated based upon $\bar{E}_{noise}$, $\bar{E}_{voice}$, and the maximum and minimum full-band energy levels measured during the previous time period, as indicated by reference numeral 38.

Next, a decision is made whether to compare the running averages of the background noise characteristics maintained by the separate G.729 Annex B and the supplemental VAD algorithms, as indicated by reference numeral 39. A decision to compare the noise characteristics of the separate VAD algorithms may be based upon an elapsed time period (e.g., one minute), a particular number of elapsed frames, or some similar measure. In a preferred embodiment, a counter, $N_{update}$, is used to count the number of consecutive frames that have been received by the integrated process 14 without the G.729 Annex B update condition, identified by reference numeral 31, having been met. When the counter reaches the particular number of consecutive frames, $T_{Nup}$, that optimally identifies the critical point of likely divergence between the running averages of the background noise characteristics generated using the separate G.729 Annex B and supplemental VAD algorithms, re-convergence using the G.729 Annex B algorithm, alone, will not likely be possible. However, convergence may be established by substituting the running averages of the supplemental background noise characteristics for those of the primary background noise characteristics. The conditions for deciding whether to substitute the supplemental background noise characteristics for those of the primary characteristics are the following:

$N_{update} > T_{Nup}$; and $N_{voice} > 5000$ (i.e., 5 seconds).

If the running averages of the background noise characteristics calculated using the G.729 Annex B and supplemental VAD algorithms have diverged, then the values for these characteristics generated by the supplemental VAD algorithm are substituted for the respective values of these characteristics generated by the G.729 Annex B algorithm. The substitution occurs in the step identified by reference numeral 41.

Thereafter, a determination of whether the link has terminated and there are no more frames to act on is made, as indicated by reference numeral 42, if any of the following conditions are met:

1. a negative determination is made in the step identified by reference numeral 39 regarding whether the optimal time has arrived to compare the running averages of the background noise characteristics generated by the G.729 Annex B and the supplemental VAD algorithms;
2. a negative determination is made in the step identified by reference numeral 40 regarding whether the running averages of the background noise characteristics generated by the G.729 Annex B and the supplemental VAD algorithms have diverged; or
3. the running averages of the background noise characteristics from the supplemental algorithm have been substituted for the respective values of the these characteristics from the G 729 Annex B algorithm, in the step identified by reference numeral 41.

If the last frame of the link has been received by the G.729 Annex B VAD, then the integrated process 14 is terminated, as indicated by reference numeral 43. Otherwise, the integrated process 14 extracts the characterization parameters from the next sequentially received frame, as indicated by reference numeral 16.

Figure 5A:
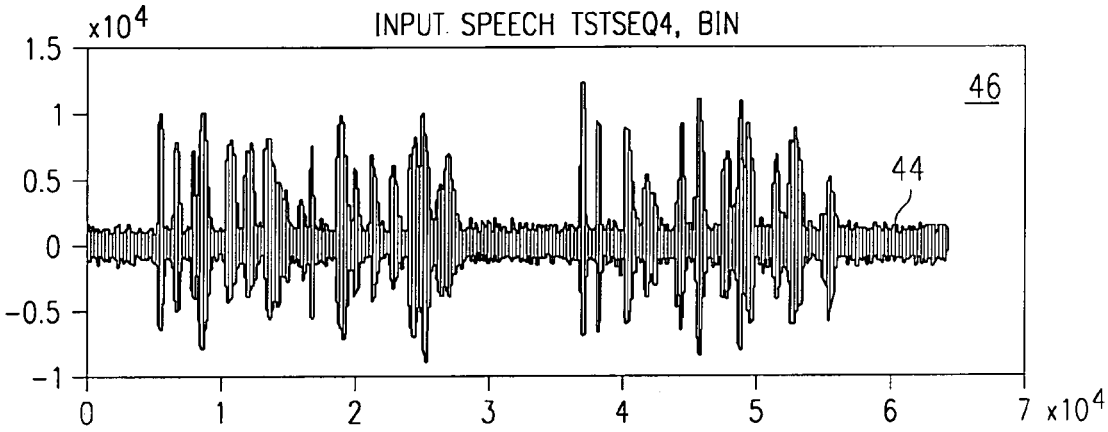
FIG. 5—illustrates a G.729B test vector signal representing a speaker's voice provided to a G.729 Annex B communication link and the G.729 Annex B VAD response to this input signal.
Figure 5B:
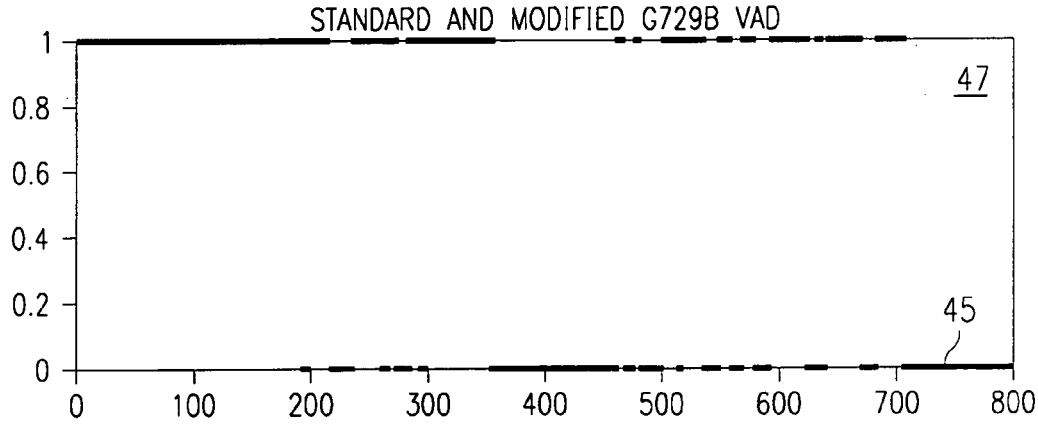

Referring now to FIG. 5, a test signal 44 representing a speaker's voice is provided to a G.729 Annex B communication link. The G.729 Annex B VAD produces the output signal 45 in response to the incoming test signal 44. The horizontal axis of graph 46 has units of time and the horizontal axis of graph 47 has units of elapsed frames. The vertical axes of both graphs have units of amplitude. An amplitude value of one for the VAD output signal 45 indicates the detected presence of voice within the frame identified by the corresponding value along the horizontal axis. An amplitude value of zero in the VAD output signal 45 indicates the lack of voice detected within the frame identified by the corresponding value along the horizontal axis.

Figure 6A:
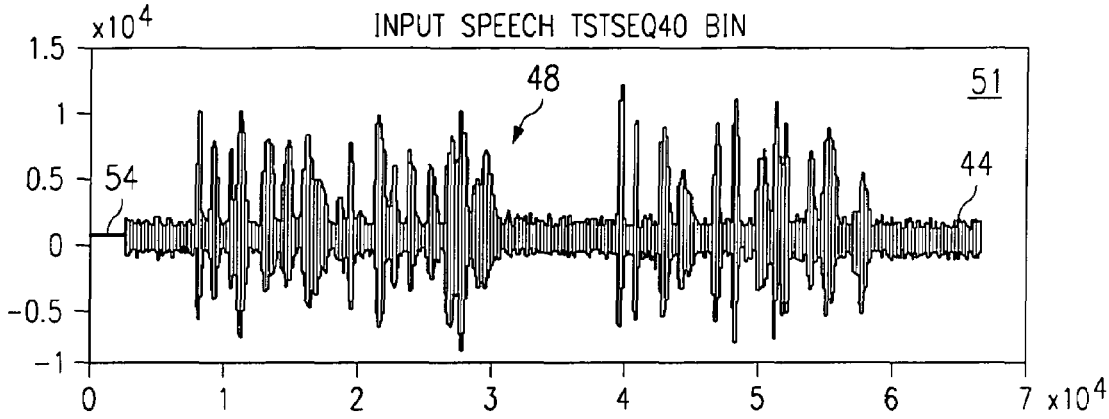
FIG. 6—illustrates the test signal of FIG. 4 with a low-level signal preceding it, the G.729 Annex B VAD response to the combined test signal, and the supplemental VAD response to the combined test signal.
Figure 6B:
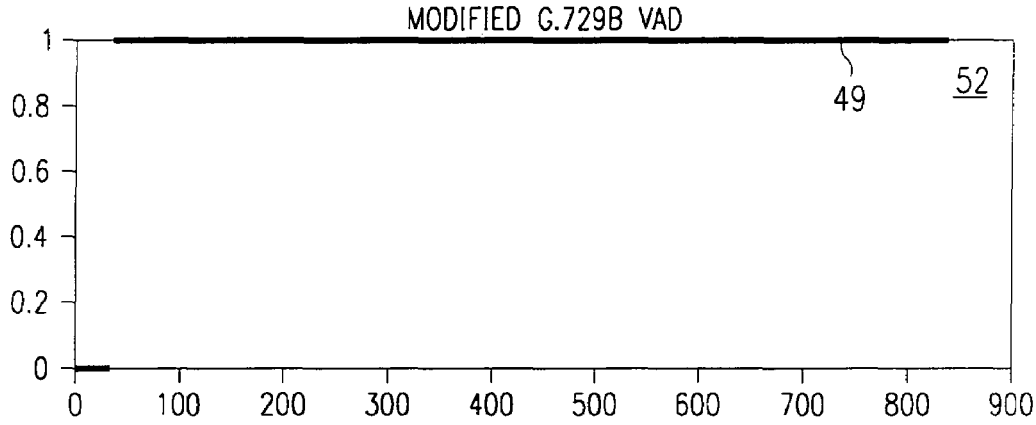
Figure 6C:
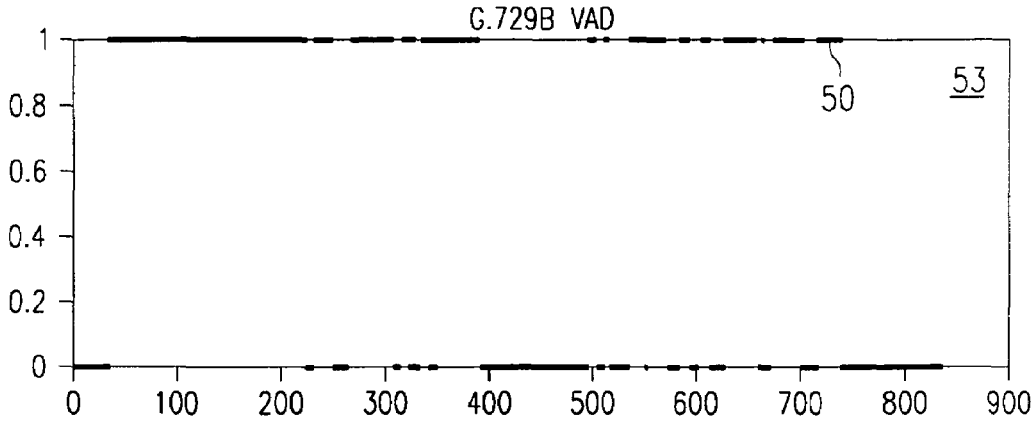

FIG. 6 illustrates the test signal 44 of graph 46 with a low-level signal 54 preceding it. Low-level signal 54 is generated by the representation of six hundred and forty consecutive zeros from a G.729 Annex B digitally encoded signal. Together, the test signal 44 and its representation of the six hundred and forty zeros forms the test signal 48 in graph 51. Graph 52 illustrates the G.729 Annex B VAD response 49 to the test signal 48. Graph 53 illustrates the response 50 to test signal 48 using the improved VAD algorithm taught by this disclosure. Notice in graph 52 that the G.729 Annex B VAD identifies all incoming frames as voice frames, after some number of initialization frames have elapsed. Because the G.729 Annex B VAD has received a very low-level signal 54 at the onset of the channel link for more than 320 ms, the VAD's characterization of the background noise has critically diverged from the expected characterization. As a result, the G.729 Annex B VAD will not perform as intended through the remaining duration of the established link. The supplemental VAD algorithm ignores the effect of the low-level signal 54 preceding the test signal 44 in combined signal 48. Therefore, the a typical noise signal does not bias the supplemental VAD's characterization of the background noise away from its expected characterization. It is instructive to note that the improved VAD's response to signal 44 in graph 53 is identical to the G.729 Annex B VAD's response to signal 44 in graph 47.

Figure 7A:
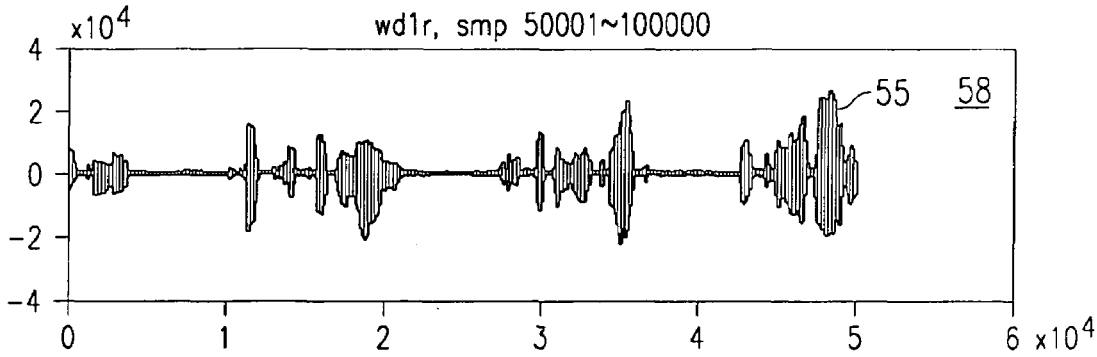
FIG. 7—illustrates a conversational test signal provided to a G.729 Annex B communication link, the response to the test signal by a standard G.729 Annex B VAD, and the supplemental VAD's response to the test signal.
Figure 7B:
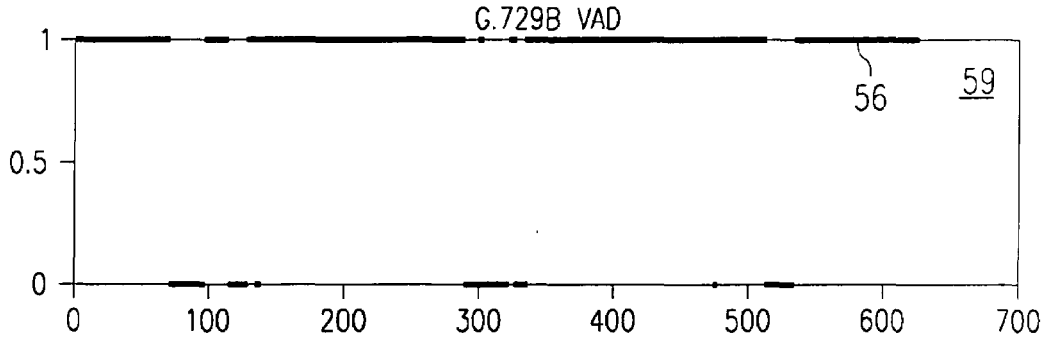
Figure 7C:
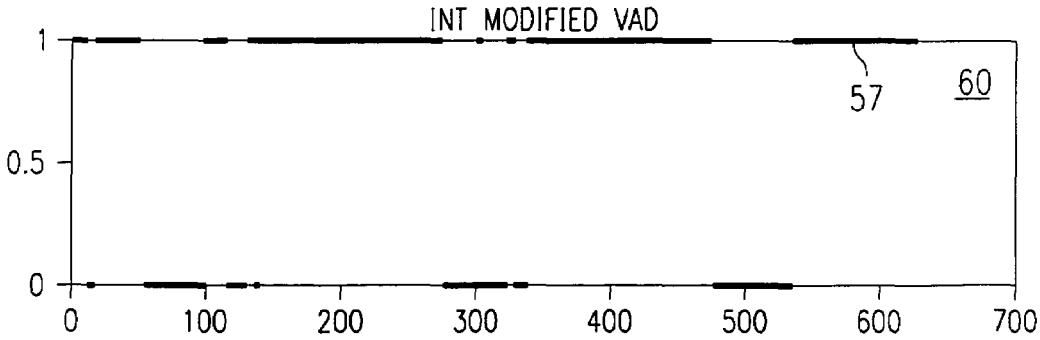

FIG. 7 illustrates a conversational test signal 55, in graph 58, provided to a G.729 Annex B communication link. Graph 59 illustrates the response 56 to test signal 55 by a standard G.729 Annex B VAD and graph 60 illustrates the improved VAD's response 57 to test signal 55. A comparison of the improved VAD response to the standard G.729 Annex B response shows that the former provides better performance in terms of bandwidth savings and reproductive speech quality.

Figure 8A:
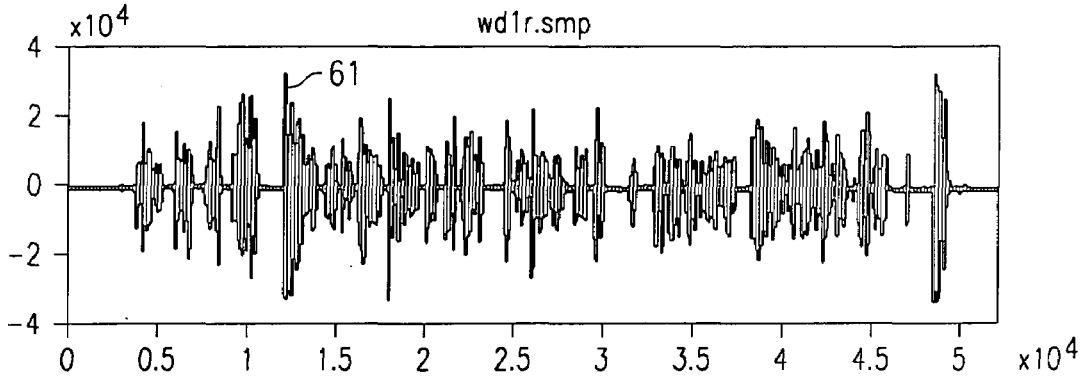
FIG. 8—illustrates a second conversational test signal provided to a G.729 Annex B communication link, the response to the test signal by a standard G.729 Annex B VAD, and the supplemental VAD's response to the test signal.
Figure 8B:
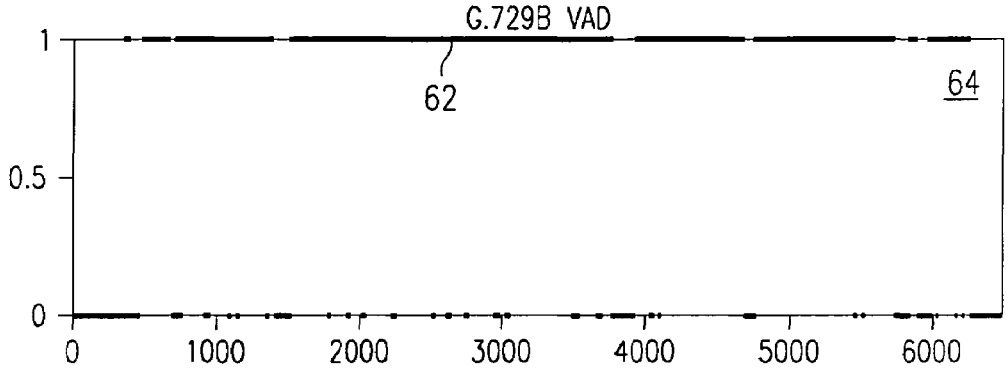
Figure 8C:
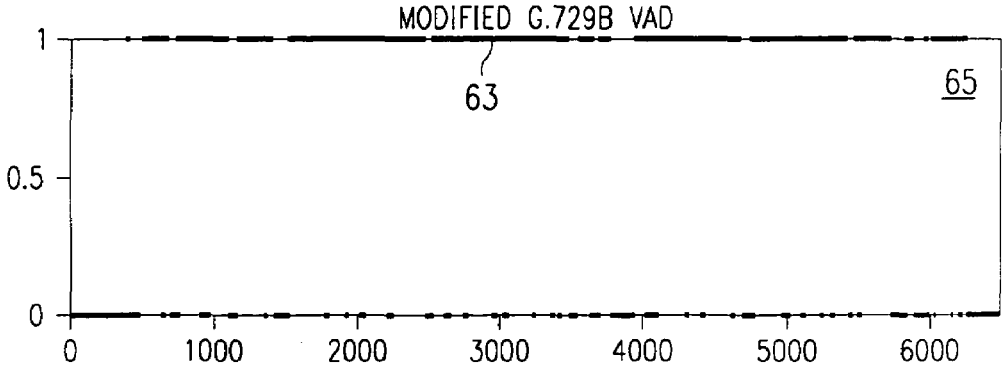

FIG. 8 illustrates another conversational test signal 61 provided to a G.729 Annex B communication link. Graph 64 illustrates the response 48 to test signal 61 by a standard G.729 Annex B VAD and graph 65 illustrates the improved VAD's response 63 to test signal 61. A comparison of the improved G.729B VAD response to the standard G.729 Annex B response shows that the former has five percent more noise frames identified than the latter, without any speech quality degradation. Therefore, the improved G.729B VAD algorithm is shown to better converge with the expected characteristics of the current frame.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A method of converging an ITU Recommendation G.729 Annex B compliant voice activity detection (VAD) device, comprising:

determining a noise identification threshold value;

determining a voice identification threshold value;

comparing a number of energy measures of a signal to a minimum threshold value, said noise identification threshold value, and said voice identification threshold value;

determining a first set of running average background noise characteristics in accordance with Recommendation G.729B;

determining a second set of running average background noise characteristics;

counting the number of consecutive times G.729 B update conditions are not met and assigning the count to a first counter variable;

substituting said second set of running average background noise characteristics for said first set when a specific event occurs; and counting the number of consecutive times said G.729 B VAD detects voice frames and assigning the count to a second counter variable, wherein said specific event occurs when a predetermined value of said second counter variable is reached.

2. The method according to claim 1, wherein;

said specific event occurs when a predetermined value of said first counter variable is reached.

3. The method according to claim 1, wherein:

said specific event occurs when both a predetermined value of said first counter variable is reached and a predetermined value of said second counter variable is reached.

4. A method of converging an ITU Recommandation G.729 Annex B compliant voice activity detection (VAD) device, comprising the steps of:

determining a noise identification threshold value;

determining a voice identification threshold value;

comparing a number of energy measures of a signal to said noise identification threshold value and said voice identification threshold value;

determining a first value representing an average of said number of energy measures, when said energy measure is less than or equal to said noise identification threshold and greater than or equal to a minimum threshold value, wherein only the energy measures of said number of energy measures having values less than said noise identification threshold value and greater than said minimum threshold value are used to determine said first value;

determining a second value representing an average of said number of energy measures, when said energy measure is greater than said voice identification threshold, wherein only the energy measures of said number of energy measures having values greater than said noise identification threshold value are used to determine said second value; and determining a first set of running average background noise characteristics in accordance with Recommandation G.729B;

determining a second set of running average background noise characteristics; and substituting said second set of running average background noise characteristics for said first set when a specific event occurs.

5. The method according to claim 4, wherein:

said noise and voice identification threshold values are based on said first and second values.

6. The method according to claim 4, further comprising the steps of:

measuring the maximum block energy occurring during an updating period, $T_p$, and assigning said measured maximum block energy to $E_{max}$; and measuring a minimum block energy occurring during said updating penod, $T_p$, and assigning said measured minimum block energy to $E_{min}$, wherein:

said noise and voice identification threshold values are based on said measured minimum and maximum block energies.

7. The method according to claim 6, wherein:

said noise and voice identification threshold values are further based on said first and second values.

* * * * *